United States Patent [19]

Kelly

[11] 4,081,927

[45] Apr. 4, 1978

[54] APPARATUS FOR GRINDING A RABBET IN AN EDGE OF A GLASS SHEET

[75] Inventor: Joseph B. Kelly, Crestline, Ohio

[73] Assignee: PPG Industries, Inc., Pittsburgh, Pa.

[21] Appl. No.: 745,705

[22] Filed: Nov. 29, 1976

[51] Int. Cl.[2] ..... B24B 17/02; B24D 7/10

[52] U.S. Cl. ..... 51/101 R; 51/127; 51/356

[58] Field of Search ..... 51/283, 284, 101 R, 51/101 LG, 209 R, 356, 127, 322

[56] References Cited

U.S. PATENT DOCUMENTS

| | | | |
|---|---|---|---|
| 1,976,233 | 10/1934 | Kosfeld | 51/283 |
| 2,332,676 | 10/1943 | Stetler | 51/356 |
| 2,579,337 | 12/1951 | Reaser | 51/283 E X |
| 2,883,800 | 4/1959 | Reaser | 51/101 R |
| 3,007,288 | 11/1961 | Brewin | 51/209 R X |
| 3,243,922 | 4/1966 | Highberg | 51/283 |
| 3,274,736 | 9/1966 | Brokaw | 51/101 R X |
| 3,754,355 | 8/1973 | Hanchett | 51/209 R |

*Primary Examiner*—Harold D. Whitehead
*Assistant Examiner*—Nicholas P. Godici
*Attorney, Agent, or Firm*—Donald Carl Lepiane

[57] ABSTRACT

A wheel having a plurality of spaced grinding pads is rotated about a vertical axis and displaced toward a glass sheet rotating in a horizontal plane to grind a rabbet in the edge of the glass sheet. The spaced grinding pads reduce frictional heat and provide periodic spacings between the glass sheet and wheel to pass a coolant therebetween to eliminate thermal damage to the glass edge.

4 Claims, 6 Drawing Figures

FIG. 3
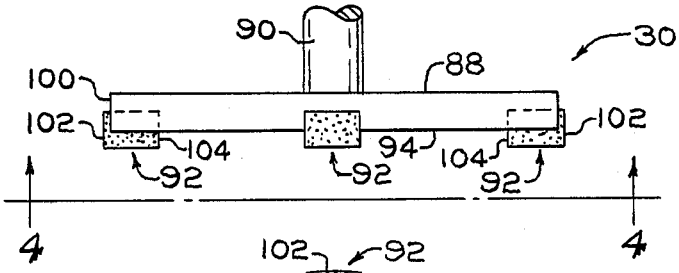
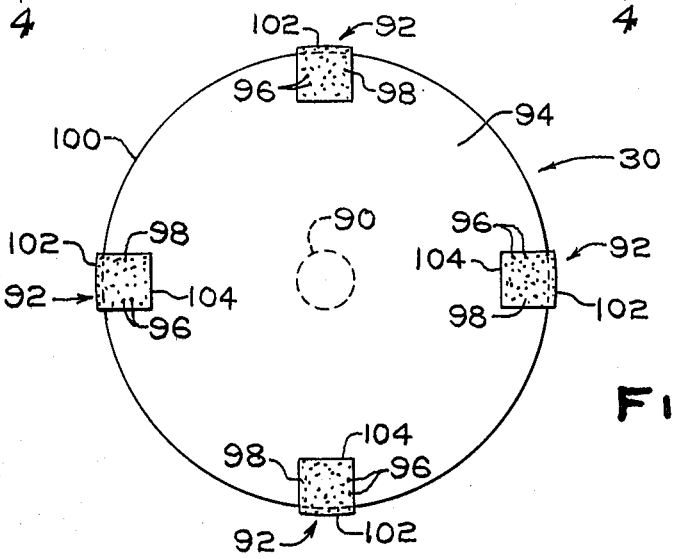
FIG. 4
FIG. 5
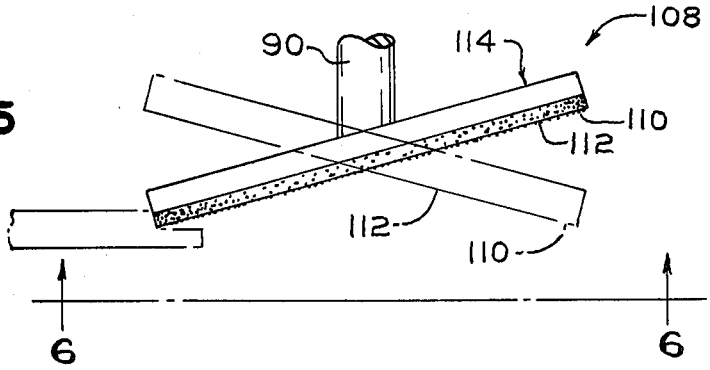
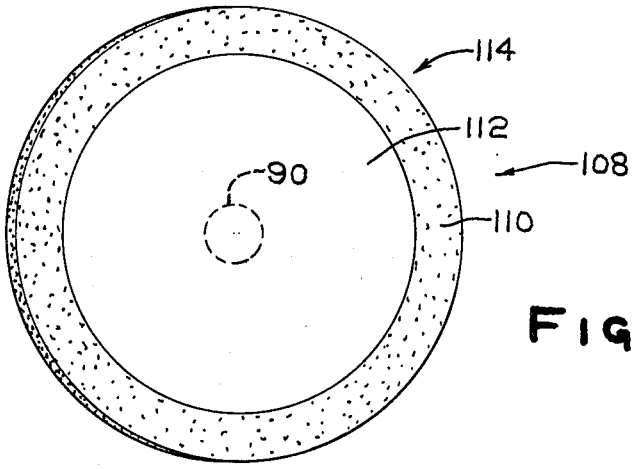
FIG. 6

APPARATUS FOR GRINDING A RABBET IN AN EDGE OF A GLASS SHEET

BACKGROUND OF THE INVENTION

1. Field of the Invention

This invention relates to a method of and apparatus for grinding a rabbet in a glass sheet and more particularly for grinding a rabbet in the peripheral edge of a glass sheet.

2. Discussion of the Technical Problems and the Prior Art

Rabbets are formed on the peripheral edges of glass sheets to seat the glass sheets in window frames, for example, window frames of aircrafts. Care has to be exercised when a rabbet is ground in a glass sheet to prevent the glass sheet from overheating. The heat is generated by friction between the grinding wheel and glass sheet. The frictional heat may crack the glass sheet, change the stress pattern in the glass sheet and/or melt the glass sheet in the grinding area.

The prior art teaches apparatus for beveling glass edges for example, U.S. Pat. No. 247,751; for removing blow over in glass jars, e.g., U.S. Pat. No. 99,160; and for grinding edges on glass sheets, for example, U.S. Pat. Nos. 2,022,530; 2,782,569; 2,795,086; 2,826,872; 3,641,711; and 3,827,198.

Although the apparatus taught in the above-identified patents are suitable for their particular application, there is no teaching in any of the patents of grinding a rabbet in the edge of a glass sheet.

It would be advantageous therefore to provide a method of and apparatus for grinding a rabbet in a glass sheet that does not thermally or mechanically damage the glass sheet.

SUMMARY OF THE INVENTION

This invention relates to a method of grinding a rabbet in a glass sheet. The sheet and grinding facilities are rotated relative to one another and maintained at a predetermined relationship as the grinding facilities intermittently engage the glass sheet.

Further this invention relates to an apparatus for grinding a rabbet in the glass sheet. Grinding facilities having spaced grinding surfaces and support facilities are rotated relative to one another. Facilities move the grinding facilities in a first direction toward the supporting facilities. Displacing facilities responsive to the rotation of the support facilities move the grinding facilities relative to the support facilities in a second direction to maintain the grinding facilities at a predetermined distance from the support facilities.

BRIEF DESCRIPTION OF THE DRAWING

FIG. 3 is a side view of a grinding wheel incorporating features of the invention that may be used with the grinding apparatus shown in FIG. 1;

FIG. 4 is a view taken along lines 4—4 of FIG. 3;

FIG. 5 is a side view of an alternate embodiment of a grinding wheel incorporating features of the invention; and FIG. 6 is a view taken along lines 6—6 of FIG. 5.

DESCRIPTION OF THE INVENTION

Figure 1:
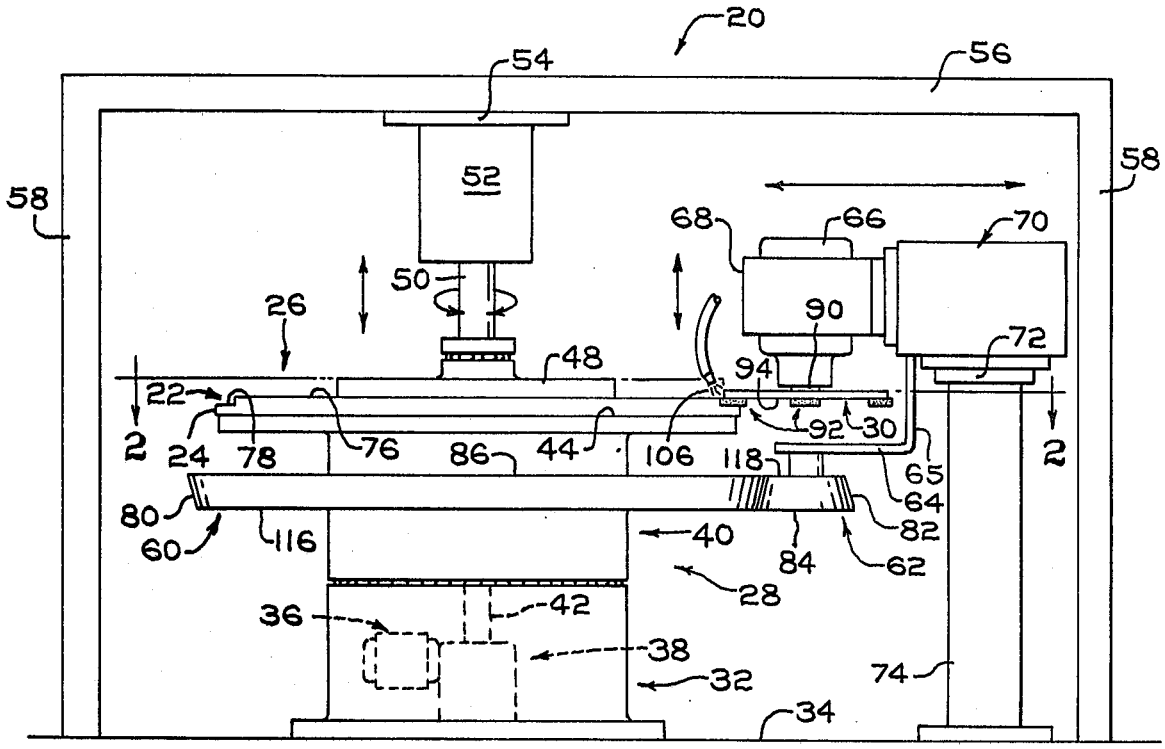
FIG. 1 is a frontal view of an apparatus incorporating features of the invention for grinding a rabbet in the edge of a glass sheet.

Referring to FIG. 1, there is shown a grinding apparatus 20 modified to incorporate features of the invention to grind a rabbet 22 in peripheral edge 24 of a sheet 26, for example, a glass sheet. The grinding apparatus 20 includes a table 28 for supporting and rotating the sheet 26 relative to grinding wheel 30, incorporating features of the invention.

The table 28 includes a lower, hollow base section 32 mounted on floor 34. The base section 32 houses a motor 36 and gear arrangement 38 for rotating upper table support section 40 by way of shaft 42. The glass sheet 26 is secured on supporting surface 44 of upper table support section 40 by a hold down member 46.

The hold down member 46 includes a plate member 48 mounted on end of freely rotatable piston 50 of a hydraulic cylinder 52. The hydraulic cylinder 52 has its end 54 mounted on cross strut 56. The cross strut 56 is supported above the floor by standards 58 as shown in FIG. 1. The piston 50 in its extended position urges the plate member 48 toward the supporting surface 44 against the glass sheet 26. In this manner, the glass sheet 26 rotates with the upper table section 40.

A cam 60 mounted on the upper table section 40 acts on cam follower 62 rotatably mounted on shaft 64.

The glass sheet 26, supporting surface 44 and cam 60 each have substantially the same peripheral configuration. The supporting surface 44 preferably has peripheral dimensions slightly less, equal to or greater than the peripheral dimensions of the glass sheet 26 so that downward forces acting on the edge 24 of the sheet during grinding are counteracted by the supporting surface 44.

The cam 60 preferably has peripheral dimensions greater than the peripheral dimensions of the sheet 26 for ease of aligning the cam 60 with the supporting surface 44 and glass sheet 26. However, as will be appreciated, the peripheral dimensions of the cam 60 is not limiting to the invention.

The cam follower 62 is mounted on the shaft 64 and preferably has its center coincident with the center of the grinding wheel 30. The shaft 64 is rotatably mounted in an "L" shaped plate 65 secured to elevator mechanism 70 in any conventional manner. A motor 66 for rotating the grinding wheel 30 is mounted by way of collar member 68 on the elevator 70. The elevator 70 is slideably mounted at 72 on vertical post 74 and urged toward the glass sheet 26 in any conventional manner, e.g., by an air cylinder (not shown). The grinding wheel 30, motor 66 and elevator 70 are moved relative to the edge 24 of the glass sheet 26 by the cam 60 acting on the cam follower 62.

As shown in FIG. 1, the vertical displacement of the motor 66 and wheel 30 determine the depth of the rabbet 22 and the horizontal displacement of the elevator 70 by the cam follower 62 determines the width of the rabbet.

Figure 2:
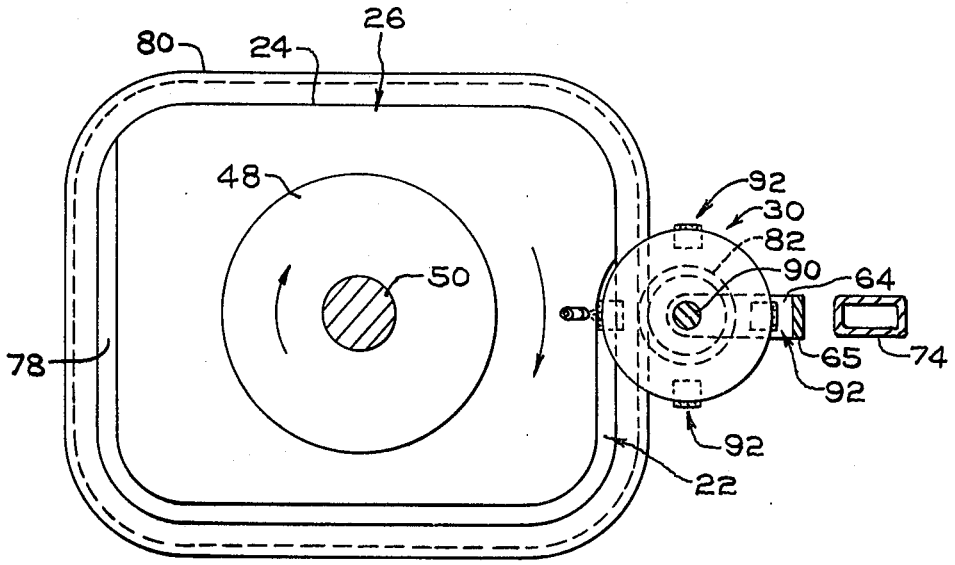
FIG. 2 is a view taken along lines 2—2 of FIG. 1.

The term "depth of the rabbet" as used herein is the vertical distance between upper surface 76 of the sheet 26 and surface 78 of the rabbet 22 as shown in FIG. 1. The term "width of the rabbet" as used herein is the distance between the peripheral edge 24 of the glass sheet 26 and wall 79 of the rabbet 22 as shown in FIG. 2.

As shown in FIG. 1, the cam 60 and cam follower 62 have oppositely sloping walls 80 and 82, respectively. Decreasing the distance between bottom surface 84 of the cam follower 62 and upper surface 86 of the cam 60 decreases the width of the rabbet and vice versa.

The apparatus thus far discussed is not limiting to the invention and may be any of the types used in the art. More particularly, the apparatus may be of the type sold by Glass Machine Specialties of Toledo, Ohio.

The discussion will now be directed to the grinding wheel 30 incorporating features of the invention. With reference to FIGS. 3 and 4, the grinding wheel 30 includes a circular disc 88 mounted on shaft 90 of the motor 66. A plurality of spaced grinding pads 92 are secured on surface 94 of the disc 88.

The grinding pads 92 include a grit material 96 held in a binder 98. The grit material 96 and binder 98 are not limiting to the invention and may be any of the types used in the art for removing glass stock. The thickness of the pads is not limiting to the invention but is preferably greater than the depth of the rabbet to prevent contact between the disc surfaces and glass. As shown in FIG. 3, the pads 92 extend beyond peripheral edge 96 of the disc to minimize contact between the edge of the disc and the glass sheet and to assure that contact is between a grinding pad and the glass sheet.

The length of the pads 92 as measured between sides 102 and 104 is not limiting to the invention but is preferably greater than the width of the rabbet. The width of the pads 92 are selected to provide a space between adjacent pads 92 to pass a coolant 106 shown in FIG. 1 between the glass sheet and the grinding wheel 30 to dissipate heat generated during grinding.

The invention is not limited to the radial distance between the pads. However, it is recommended that sufficient distance be provided so that the coolant may dissipate heat from the glass to prevent heating of the glass sheet edge. If the glass sheet edge overheats, the edge may crack, the edge stress pattern may be altered or, in some instances, the edge may melt. It is recommended that the temperature of the glass during grinding be less than about 150° F. (66° C.) to prevent thermal damage to the glass sheet.

Frictional heat generated during grinding, for purposes of the instant invention, is considered to be a function of rotational speed of the grinding wheel 30, rotational speed of the glass sheet 26, vertical displacement speed of the grinding wheel 30, size of the grit 96, surface area contact of a pad 92 and the spaced distance between the pads 92.

Increasing the rotational speed of the grinding wheel while keeping the remaining parameters constant, increases frictional heat and vice versa. Increasing the rotational speed of the glass sheet 26 while keeping the remaining parameters constant increases the frictional heat and vice versa. Increasing the vertical displacement of the grinding wheel 30 while keeping the remaining parameters constant increases the frictional heat and vice versa. Increasing the grit size while keeping the remaining parameters constant decreases frictional heat and vice versa. However, increasing grit size tends to chip the glass edge and is not acceptable. Increasing the surface area contact of pads 92 while keeping the remaining parameters constant increases frictional heat and vice versa. Decreasing the spaced distance between the pads 92 while keeping the remaining parameters constant, increases the frictional speed and vice versa.

For purposes of the invention, dissipation of frictional heat from the glass is a function of coolant flow, heat dissipation value of the coolant and the spaced distance between the bottom surface 94 of the grinding wheel 30 and the glass. In the practice of the invention, the coolant is preferably continuously flowed over the wheel and glass during grinding.

Increasing the coolant flow while keeping the remaining parameters constant increases heat removal from the grinding area and vice versa. Increasing the heat dissipation value of the coolant while maintaining the remaining parameters constant, increases heat removal and vice versa. Increasing the spaced distance between the bottom surface 94 of the grinding wheel 30 and the glass while keeping the remaining parameters constant increases heat removal and vice versa.

An additional feature of the grinding wheel 30 is that each time a pad 92 engages the glass, the engaging pad corner cuts into the glass to more efficiently remove glass stock.

Referring to FIGS. 5 and 6, there is shown an alternate embodiment of a grinding wheel 108 incorporating features of the invention. The grinding wheel 108 has a continuous ring 110 of grinding material on surface 112 of a disk 114. The ring 110 has its center coincident with the center of the disk 114. The grinding wheel 108 is mounted on the motor shaft 90 such that the axial center of the shaft 90 and the plane of the grinding surface of the wheel 108 subtends an oblique angle.

As shown in FIG. 5, with this arrangement the wheel contacts the glass at a selected interval depending on the angle. For example, as the angle decreases, the area of contact between the wheel and glass increases and vice versa. Although not limiting to the invention, grit may be added to the peripheral surface of the wheel 108.

As can now be appreciated, the invention is not limited to the shape of the glass sheet, composition of the glass sheet, depth of the rabbet or width of the rabbet. For example, the glass sheet may have a circular or rectangular shape.

DETAILED DESCRIPTION OF THE INVENTION

With reference to FIG. 2, a glass sheet 26 having a generally rectangular shape with radiused corners is provided with a rabbet in accordance to the teachings of the invention. The glass sheet has a thickness of about 0.312 inch (0.8 centimeter); a width of about 11 inches (0.28 meter); a length of about 16 inches (0.4 meter); and rounded corners having a radius of about 1.5 inches (3.8 centimeters). The grinding apparatus 20 is similar to the type sold by Glass Machine Specialities, Toledo, Ohio.

Supporting surface 44 has generally the same peripheral configuration and dimensions of the glass sheet 26. Cam 60 mounted on supporting surface 44 of upper table section 40 has generally the same peripheral configuration as the glass.

The cam 60 is made of 0.5 inch (1.27 centimeter) thick steel plate having upper surface 86 having peripheral dimensions of about 2 inches (5.08 centimeters) greater than corresponding peripheral dimensions of the glass sheet 26. The upper surface 86 of the cam is spaced about 4 inches (10 centimeters) from the supporting surface 44.

Cam follower 62 rotatably mounted on shaft 30 has a thickness of about 2.75 inches (7 centimeters); an upper surface 114 having a diameter of about 5 inches (13 centimeters); a bottom surface 84 having a diameter of about 9 inches (23 centimeters). Corresponding surfaces of the cam follower 62 and cam 60 are aligned Referring now to FIGS. 3 and 4, a wheel 30 includes a steel disc 88 having a diameter of about 11.25 inches (0.3 meter) and a thickness of about 0.5 inch (1.27 centimeter). Four pads 92 having a length of about 1.5 inch (4.8 centimeters); a width of about 0.5 inch (1.27 centimeter) and a thickness of about 0.5 inch (1.27 centimeter) are mounted on bottom surface 94 of the disc 88 spaced about 90° apart. The pads 92 each extend about 0.125 inch (0.32 centimeter) beyond the peripheral edge 100 of the disc.

The pads 92 are made of diamond grit 96 mixed in a binder of bronze-steel powdered metal of the type sold by Norton Company and secured to the disc in any conventional manner.

The grinding wheel 30 is mounted on motor shaft 90 of motor 66 with the pads 92 lying in a plane generally parallel to the plane of the supporting surface 44.

The glass sheet 26 is positioned on and aligned with the supporting surface 44. Plate member 48 rotatably mounted on shaft 50 of hydraulic cylinder 52 holds the glass sheet against the supporting surface. Thereafter, the cam 60 is aligned with the glass sheet.

The glass sheet 24 is rotated at a speed of about 5 revolutions per minute (rpm's) by motor 36, gear arrangement 38 and shaft 42 mounted in lower hollow table section 32.

Referring now to FIG. 1, the cam follower 62 is mounted on shaft 64 which is rotatably mounted on "L" shaped plate 65 connected to elevator 70. The elevator 70 is slideably mounted at 72 on post 74 and biased toward the glass sheet to urge the cam follower 62 against the cam 60.

The motor 66 rotates the grinding wheel 30 at 3600 rpm's as the grinding wheel is displaced downward as viewed in FIG. 1 toward the glass at a linear speed of about 1.44 inch (3.7 centimeters) per hour by the elevator 70.

A soluble oil-water coolant is continuously flowed at a rate of about 20 to 50 gallons per minute (gpm) onto the glass and wheel.

As the cam 60 and glass 24 are rotated, the cam follower 62 horizontally displaces the grinding wheel to cut a rabbet having a depth of about 0.120 inch (0.3 centimeter) and a width of about 0.75 inch (2 centimeters).

As the grinding wheel 30 rotates, a grinding pad 92 moves across the glass and away from the glass. At the instant of time when there is no pad in contact with the glass, the coolant flows between the glass and wheel to cool the glass.

The wheel 108 shown in FIGS. 5 and 6 is used to cut a similar rabbet in the glass sheet.

The grinding wheel 108 having a diameter of about 11.25 inches (0.3 meter) is made from a steel plate having a thickness of about 0.5 inch (1.27 centimeter). A ring of grit about ⅝ inch (1.6 centimeter) wide extends from the peripheral edge inward. The grit is similar to that discussed for the wheel shown in FIGS. 3 and 4. The wheel is mounted on the motor shaft 90 such that the plane of the surface 112 containing the grit and the center of the shaft subtend an oblique angle of about 0.51° to 0.30°.

The grinding wheel is displaced toward the glass sheet as previously discussed. As the wheel rotates, a portion of the wheel engages the glass to remove stock as the coolant flows onto the glass and wheel. When the portion of the wheel moves past the glass, the coolant flows (1) between the glass and wheel and (2) over the glass and wheel to cool the glass. The above is repeated for each rotation of the wheel.

As can now be appreciated, the invention is not limited to the above examples which were presented for illustration purposes only.

What is claimed is:

1. An apparatus for grinding a recess in marginal edge portions of a glass sheet, comprising:

means for supporting the sheet;

a flat disc;

a circular band of grinding material on a surface of said disc;

shaft means mounting said disc such that the axial center of said shaft means and plane of said disc subtend an oblique angle;

means acting on said shaft means for rotating said disc through a circular oscillatory path to move said band of grinding material toward, through and away from a plane generally parallel to said supporting means; and means for decreasing the distance between said band of grinding material and said supporting means as said disc is rotated.

2. The apparatus as set forth in claim 1 further including:

means for directing a coolant over said grinding means.

3. The apparatus as set forth in claim 1 wherein said decreasing means includes an elevator and further including:

a cam mounted on said supporting means;

means for biasing said elevator toward said supporting means;

a cam follower;

means connecting said cam follower to said elevator to move said elevator relative to said supporting means against the action of said biasing means.

4. The apparatus as set forth in claim 1 further including:

means for rotating said supporting means.

* * * * *